US011397061B2

(12) United States Patent
Noishiki

(10) Patent No.: US 11,397,061 B2
(45) Date of Patent: Jul. 26, 2022

(54) FLUID FLOW-PATH DEVICE

(71) Applicant: KOBE STEEL, LTD., Hyogo (JP)

(72) Inventor: Koji Noishiki, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 124 days.

(21) Appl. No.: 17/041,396

(22) PCT Filed: Apr. 5, 2019

(86) PCT No.: PCT/JP2019/015118
§ 371 (c)(1),
(2) Date: Sep. 24, 2020

(87) PCT Pub. No.: WO2019/203025
PCT Pub. Date: Oct. 24, 2019

(65) Prior Publication Data

US 2021/0041190 A1 Feb. 11, 2021

(30) Foreign Application Priority Data

Apr. 17, 2018 (JP) ..... JP2018-079072

(51) Int. Cl.
*F28F 9/02* (2006.01)
*F28G 9/00* (2006.01)
(Continued)

(52) U.S. Cl.
CPC ..... *F28F 9/0246* (2013.01); *F28F 9/0202* (2013.01); *F25B 39/028* (2013.01);
(Continued)

(58) Field of Classification Search
CPC .. F28G 9/00; F28G 2015/006; F02B 29/0468; F22B 37/003; F28F 9/0202
See application file for complete search history.

(56) References Cited

U.S. PATENT DOCUMENTS 1,795,348 A * 3/1931 Schmidt ..... F28G 1/12 451/39
1,963,412 A * 6/1934 Lewis ..... F24F 6/06 237/78 R
(Continued)

FOREIGN PATENT DOCUMENTS

FR 3009201 A1 * 2/2015 ..... B01D 29/03
JP 57184896 A * 11/1982
(Continued)

*Primary Examiner* — Paul Alvare
(74) *Attorney, Agent, or Firm* — Studebaker & Brackett PC

(57) ABSTRACT

A fluid flow-path device facilitates a maintenance operation to remove a foreign substance adhered to a member, to prevent passage of the foreign material. The fluid flow-path device has a distribution header including a partition member and a header body in a flow-path formation body. The partition member partitions a distribution space of the distribution header into an upstream-side space that communicates with a supply opening in the header body, and a downstream-side space that communicates with a plurality of flow paths in the flow-path formation body. The partition member includes a region that prevents a foreign substance in a fluid from flowing from the upstream-side space to the downstream-side space, while allowing the fluid to flow. The header body has an opening that allows a washing fluid to flow into the downstream-side space, and an opening that allows the washing fluid to be discharged from the upstream-side space.

4 Claims, 4 Drawing Sheets

(51) Int. Cl.
*F25B 39/02* (2006.01)
*F28G 15/00* (2006.01)

(52) U.S. Cl.
CPC ..... *F28F 9/028* (2013.01); *F28G 9/00* (2013.01); *F28G 2015/006* (2013.01)

(56) References Cited

U.S. PATENT DOCUMENTS 4,237,962 A * 12/1980 Vandenhoeck ..... F23J 3/02 165/95
4,567,940 A * 2/1986 Klaren ..... F28D 13/00 34/578
4,764,254 A * 8/1988 Rosenblad ..... B01D 3/008 162/251
5,272,874 A * 12/1993 Paas ..... F01N 3/046 165/95
5,336,331 A * 8/1994 Jenkins ..... F28G 15/04 165/95
5,442,921 A * 8/1995 Chow ..... F28F 9/0229 165/95
6,308,774 B1 * 10/2001 Kramer ..... G21F 9/004 165/95
8,419,812 B2 * 4/2013 Ershag ..... C10B 1/04 165/145
2005/0121174 A1 * 6/2005 Majarais ..... F22B 37/483 165/95
2010/0313913 A1 * 12/2010 Hollwedel ..... B08B 9/00 134/22.11
2012/0318474 A1 * 12/2012 Lieskoski ..... F28D 1/0472 165/45
2014/0374064 A1 * 12/2014 Almalowi ..... B01D 53/002 165/104.13

FOREIGN PATENT DOCUMENTS

JP 08291994 A * 11/1996
JP 4149308 B2 * 9/2008
WO 2014/122890 A1 8/2014

* cited by examiner

FLUID FLOW-PATH DEVICE

TECHNICAL FIELD

The present invention relates to a fluid flow-path device including multiple flow paths in which fluid flows.

BACKGROUND ART

A fluid flow-path device including multiple flow paths in which fluid flows has been known. Such a fluid flow-path device is used for a heat exchanger configured to cool cooling target fluid by heat exchange between the cooling target fluid and cooling fluid as described in, e.g., Patent Document 1.

The heat exchanger described in Patent Document 1 includes a flow-path structure, a supply header, and a discharge header. The flow-path structure has multiple first flow paths in which the cooling target fluid flows and multiple second flow paths in which the cooling fluid for cooling the cooling target fluid flows. The supply header is arranged such that the cooling fluid is supplied to the multiple second flow paths through the supply header. The discharge header is arranged such that the cooling fluid is discharged from the multiple second flow paths through the discharge header. At the flow-path structure, multiple introduction ports for introducing the cooling target fluid into each of the multiple first flow paths and multiple discharge ports for discharging the cooling target fluid from each of the multiple first flow paths are formed. In the heat exchanger described in Patent Document 1, the cooling target fluid is cooled by heat exchange between the cooling target fluid flowing in each of the multiple first flow paths and the cooling fluid flowing in each of the multiple second flow paths.

However, in the above-described heat exchanger, there is a probability that when a foreign substance contained in the fluid enters the flow path, the foreign substance is caught by an inner surface of the flow path and blocks the flow path. As the technique of preventing clogging of the flow path due to entrance of the foreign substance as described above, prevention of entrance of the foreign substance into the flow path is conceivable. For example, it is conceivable that a strainer is arranged at a pipe which is connected to the supply header and in which the fluid flows toward the supply header and the strainer allows passage of the fluid while preventing passage of the foreign substance contained in the fluid. The strainer can trap the foreign substance contained in the fluid, and can remove the foreign substance from the fluid.

However, for maintaining a foreign substance removal function by the strainer, maintenance as the process of removing the foreign substance adhering to the strainer from the strainer is necessary. For performing such maintenance, the burdensome process of detaching the strainer from the pipe to wash the strainer in a state in which the flow of the fluid in the pipe is stopped is necessary.

In addition, due to a small flow path area in the pipe, it is difficult to ensure the area of a portion (e.g., a mesh) for preventing passage of the foreign substance contained in the fluid while allowing passage of the fluid in the strainer. For this reason, the number of times of burdensome maintenance as described above increases. Further, a space for arranging the strainer is necessary in the pipe, and in some cases, a space with the same size as that of the heat exchanger is necessary. Moreover, the pressure of the fluid acts on the strainer, and for this reason, it is necessary to design the strainer as a pressure-resistant member, and depending on the design pressure, the strainer needs to have an extremely-great thickness.

CITATION LIST

Patent Document

Patent Document 1: JP 2014-152963 A

SUMMARY OF THE INVENTION

An objective of the present invention is to provide a fluid flow-path device including a member configured to prevent passage of a foreign substance and capable of easily performing the process of removing the foreign substance adhering to the member from the member. Provided is a fluid flow-path device for supplying target fluid. The fluid flow-path device includes a flow-path formation body having multiple flow paths and a side surface, the multiple flow paths being formed inside the flow-path formation body and allowing the flow of the target fluid in the flow paths and an inlet of each of the multiple flow paths opening at the side surface; and a distribution header arranged on the side surface to cover the inlet of each of the multiple flow paths and forming a distribution space for distributing the target fluid to each of the multiple flow paths between the distribution header and the flow-path formation body. The distribution header includes a header body having a recessed portion and a supply port, the recessed portion opening to the side surface to form the distribution space in a state in which the distribution header is arranged on the side surface and the supply port being communicated with the distribution space to allow supply of the target fluid to the distribution space through the supply port; and a partition member provided at the header body at a position in the distribution space, partitioning the distribution space into an upstream-side space communicated with the supply port and a downstream-side space communicated with each of the multiple flow paths at a position closer to the flow-path formation body than the upstream-side space is to, and having a fluid passable portion allowing the target fluid supplied into the distribution space through the supply port to flow to the downstream-side space from the upstream-side space while preventing a foreign substance contained in the target fluid from flowing to the downstream-side space from the upstream-side space. The header body is formed with an introduction port and a discharge port, the introduction port is communicated with the downstream-side space such that washing fluid for discharging the foreign substance adhering to the fluid passable portion from the inside of the space to the outside of the distribution header is supplied to the downstream-side space through the introduction port and passes through the fluid passable portion in a direction from the downstream-side space toward the upstream-side space to remove the foreign substance adhering to the fluid passable portion from the fluid passable portion, and the discharge port is communicated with the upstream-side space such that the washing fluid containing the foreign substance removed from the fluid passable portion by passing through the fluid passable portion in the direction from the downstream-side space toward the upstream-side space is discharged to the outside of the distribution header from the upstream-side space through the discharge port.

DESCRIPTION OF EMBODIMENTS

Hereinafter, an embodiment of the present invention will be described with reference to the attached drawings.

Figure 1:
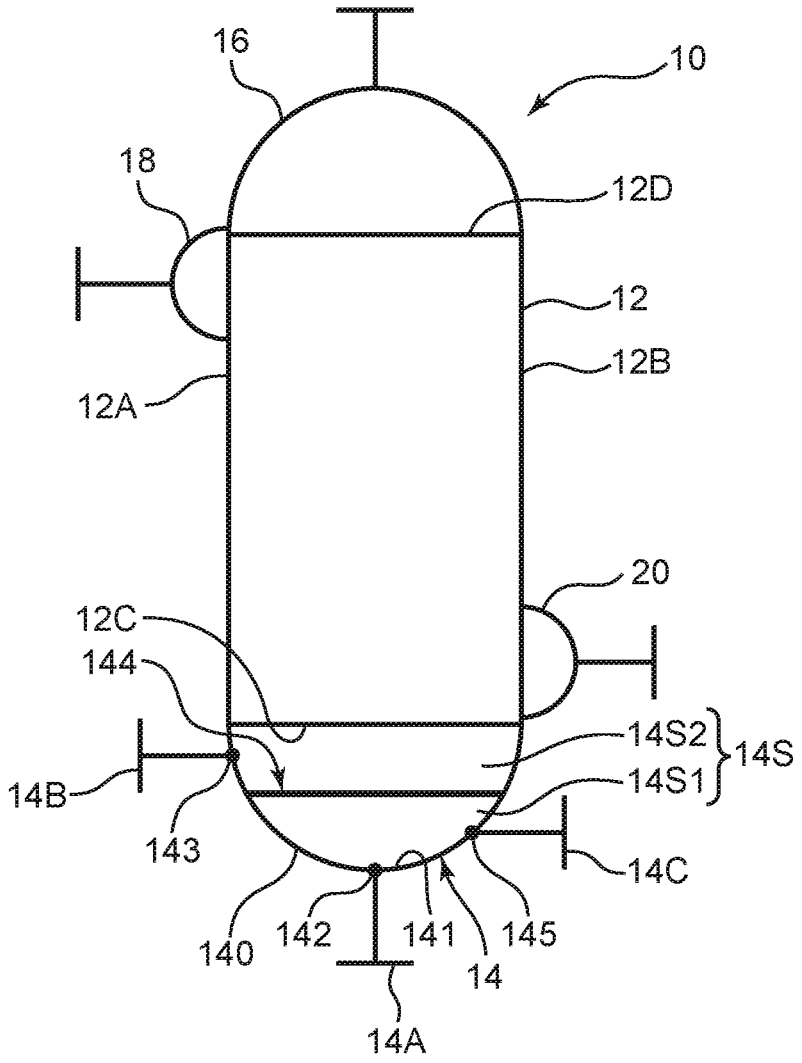
FIG. 1 is a side view of a heat exchanger according to an embodiment of the present invention.
Figure 2:
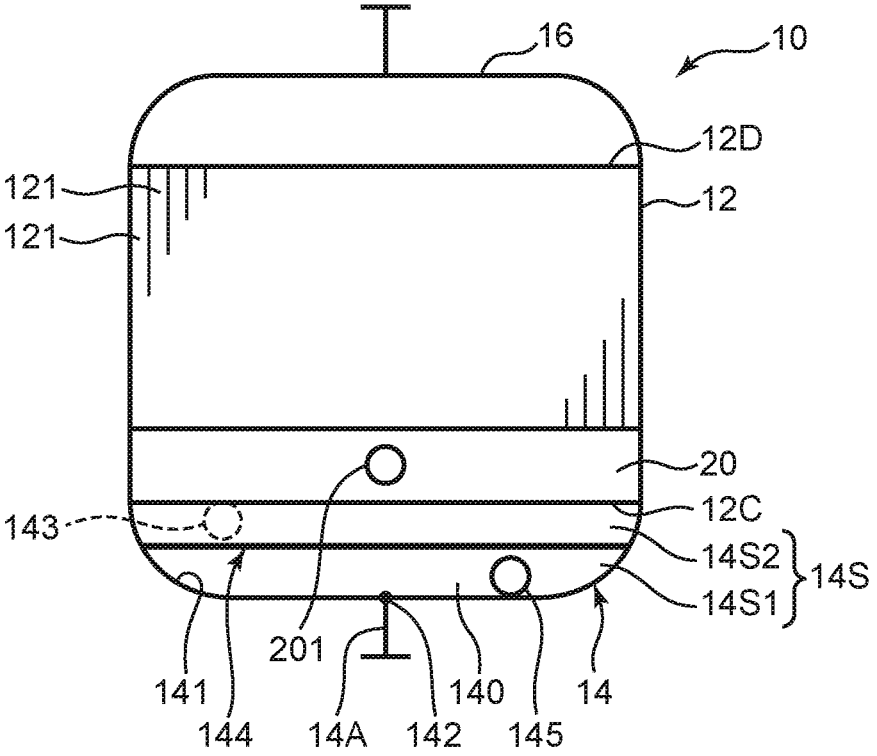
FIG. 2 is a front view of the heat exchanger according to the embodiment of the present invention.

A heat exchanger 10 as a fluid flow-path device according to the embodiment of the present invention will be described with reference to FIGS. 1 and 2. FIG. 1 is a side view of the heat exchanger 10. FIG. 2 is a front view of the heat exchanger 10.

The heat exchanger 10 cools cooling target gas as a cooling target by cooling water as refrigerant. The heat exchanger 10 includes a flow-path formation body 12, a gas distribution header 18, a gas discharging header 20, a cooling water distribution header 14 as a distribution header, and a cooling water discharging header 16.

The flow-path formation body 12 has not-shown multiple gas flow paths, side surfaces 12A, 12B, not-shown multiple cooling flow paths, and side surfaces 12C, 12D. The multiple gas flow paths are formed inside the flow-path formation body 12, and allow the cooling target gas to flow in each of the multiple gas flow paths. Each of the multiple gas flow paths has a not-shown gas inlet and a not-shown gas outlet on the opposite side of the gas inlet. The inlet of each of the multiple gas flow paths opens at the side surface 12A. The outlet of each of the multiple gas flow paths opens at the side surface 12B. The multiple cooling flow paths are formed inside the flow-path formation body 12, and allow the cooling water as "target fluid" in this embodiment to flow in each of the multiple gas flow paths. Each of the multiple cooling flow paths has a cooling water inlet and a cooling water outlet on the opposite side of the cooling water inlet. The cooling water inlet of each of the multiple cooling flow paths opens at the side surface 12C. The cooling water outlet of each of the multiple cooling flow paths opens at the side surface 12D.

The flow-path formation body 12 includes multiple substrates 121, and these multiple substrates 121 are bonded to each other with the substrates 121 being stacked on each other in a stacking direction parallel with a thickness direction of each substrate 121. The multiple gas flow paths are, for example, formed between two of the multiple substrates 121 stacking on each other in the stacking direction. The multiple cooling flow paths are, for example, formed between two of the multiple substrates 121 stacking on each other in the stacking direction. The multiple cooling flow paths are each adjacent to the multiple gas flow paths in the stacking direction. By indirect heat exchange between the cooling water flowing in each of the multiple cooling flow paths and the cooling target gas flowing in each of the multiple gas flow paths, the cooling target gas flowing in each of the multiple gas flow paths is cooled.

The gas distribution header 18 is arranged on the side surface 12A to cover the gas inlet of each of the multiple gas flow paths, and between the gas distribution header 18 and the flow-path formation body 12, forms a gas distribution space for distributing the cooling target gas to each of the multiple gas flow paths.

The gas discharging header 20 is arranged on the side surface 12B to cover the gas outlet of each of the multiple gas flow paths, and between the gas discharging header 20 and the flow-path formation body 12, forms a gas collection space for collecting the target gas discharged from each of the multiple gas flow paths.

The cooling water distribution header 14 is for distributing the cooling water as the "target fluid." The cooling water distribution header 14 is arranged on the side surface 12C to cover the cooling water inlet of each of the multiple cooling flow paths, and between the cooling water distribution header 14 and the flow-path formation body 12, forms a cooling water distribution space 14S as a distribution space for distributing the cooling water to each of the multiple cooling flow paths. Details of the cooling water distribution header 14 will be described later.

The cooling water discharging header 16 is arranged on the side surface 12D to cover the cooling water outlet of each of the multiple cooling flow paths, and between the cooling water discharging header 16 and the flow-path formation body 12, forms a water collection space as a space for collecting the cooling water discharged from each of the multiple cooling flow paths.

The gas distribution header 18 distributes the cooling target gas to each of the multiple gas flow paths such that the cooling target gas flows in each of the multiple gas flow paths. The cooling water distribution header 14 distributes the cooling water to each of the multiple cooling flow paths such that the cooling water flows in each of the multiple cooling flow paths. The cooling target gas flowing in each of the multiple gas flow paths is cooled by indirect heat exchange with the cooling water flowing in each of the multiple cooling flow paths.

There is a probability that when a foreign substance contained in the cooling water is caught by an inner surface of each of the multiple cooling flow paths, the foreign substance blocks such a cooling flow path and causes a clog. For preventing such a clog, the cooling water distribution header 14 has a configuration for preventing the foreign substance from entering each of the multiple cooling flow paths. Hereinafter, such a configuration will be described in detail.

The cooling water distribution header 14 has a header body 140 and a partition member 144. The header body 140 is fixed to the side surface 12C to form the cooling water distribution space 14S between the header body 140 and the side surface 12C. The partition member 144 partitions the cooling water distribution space 14S into an upstream-side space 14S1 and a downstream-side space 14S2.

The header body 140 has a recessed portion 141 and a supply port 142. The recessed portion 141 forms the cooling water distribution space 14S. The supply port 142 is formed to allow supply of the cooling water to the cooling water distribution space 14S through the supply port 142.

The header body 140 is, by welding etc., fixed to the side surface 12C to cover the cooling water inlet of each of the multiple cooling flow paths in such a posture that the recessed portion 141 opens to the side surface 12C. With this configuration, the cooling water distribution space 14S is formed between the header body 140 and the side surface 12C. Thus, the recessed portion 141 opens to the cooling water inlet of each of the multiple cooling flow paths.

The supply port 142 is communicated with the cooling water distribution space 14S, and accordingly, allows supply of the cooling water to the cooling water distribution space 14S through the supply port 142. A supply connector 14A is connected to the supply port 142. A not-shown cooling water supply pipe in which the cooling water to be supplied to the cooling water distribution space 14S flows is connected to the supply connector 14A. The cooling water flows into the cooling water distribution space 14S, i.e., is supplied to the cooling water distribution space 14S, through the cooling water supply pipe and the supply connector 14A.

The partition member 144 is fixed to the header body 140 at a position inside the cooling water distribution space 14S, and partitions the cooling water distribution space 14S into the upstream-side space 14S1 and the downstream-side space 14S2. The supply port 142 is communicated with the upstream-side space 14S1. The downstream-side space 14S2 is at a position closer to the flow-path formation body 12 than the upstream-side space 14S1 is to, and is communicated with the cooling water inlet of each of the multiple cooling flow paths.

The partition member 144 has a thin plate shape. The partition member 144 expands in a direction (a horizontal direction in a posture shown in FIG. 1) perpendicular to a supply port opening direction (an upper-lower direction in FIGS. 1 and 2) as a direction in which the supply port 142 opens to the partition member 144. The partition member 144 is arranged in parallel with the side surface 12C.

Figure 3:
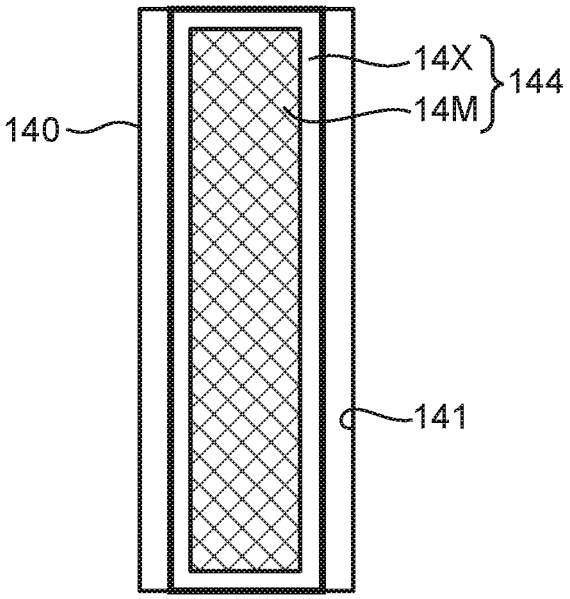
FIG. 3 is a plan view of a partition member from above FIG. 1, the partition member being positioned inside a header body of a cooling water distribution header of the heat exchanger shown in FIG. 1.

Details of the partition member 144 will be described with reference to FIG. 3. FIG. 3 shows a state in which the partition member 144 positioned inside the header body 140 is viewed from the upper side of FIG. 1.

The partition member 144 has a fluid passable portion 14M and a surrounding portion 14X. The surrounding portion 14X is a portion surrounding the fluid passable portion 14M, and is fixed to the header body 140.

The fluid passable portion 14M allows the cooling water supplied into the cooling water distribution space 14S through the supply port 142 to flow into the downstream-side space 14S2 from the upstream-side space 14S1 through the fluid passable portion 14M while preventing the foreign substance contained in the cooling water from flowing from the upstream-side space 14S1 to the downstream-side space 14S2.

The fluid passable portion 14M is a mesh, for example. In a case where the fluid passable portion 14M is the mesh, the size of the mesh is set as necessary according to the size of the foreign substance. The size of the mesh of the fluid passable portion 14M is 80 mesh, for example. The foreign substance whose flow from the upstream-side space 14S1 to the downstream-side space 14S2 is blocked by the fluid passable portion 14M adheres to the fluid passable portion 14M, for example.

The surrounding portion 14X is fixed to an inner surface of the header body 140, specifically a surface of the recessed portion 141, across the entire circumference of the surrounding portion 14X. The method for fixing the surrounding portion 14X to the inner surface of the header body 140 is not limited. Such a method is welding, for example.

Referring to FIGS. 1 and 2 again, the header body 140 will be described. An introduction port 143 and a discharge port 145 are formed at the header body 140. The introduction port 143 is communicated with the downstream-side space 14S2 such that supply of a washing solution as washing fluid to the downstream-side space 14S2 through the introduction port 143 is allowed. The discharge port 145 is communicated with the upstream-side space 14S1 such that discharging of the washing solution from the upstream-side space 14S1 through the discharge port 145 is allowed.

The washing solution is liquid supplied into the cooling water distribution space 14S for discharging the foreign substance adhering to the fluid passable portion 14M from the inside of the cooling water distribution space 14S to the outside of the cooling water distribution header 14. The washing solution passes through the fluid passable portion 14M in a direction from the downstream-side space 14S2 toward the upstream-side space 14S1. At this point, the foreign substance adhering to the fluid passable portion 14M is removed from the fluid passable portion 14M, and is contained in the washing solution having passed through the fluid passable portion 14M. As described above, the washing solution containing the foreign substance after having passed through the fluid passable portion 14M is discharged from the upstream-side space 14S1 to the outside of the cooling water distribution header 14.

The introduction port 143 is communicated with the downstream-side space 14S2 such that supply of the washing solution to the downstream-side space 14S2 through the introduction port 143 is allowed. An introduction connector 14B is connected to the introduction port 143. A not-shown washing solution introduction pipe is connected to the introduction connector 14B, and the washing solution to be supplied to the downstream-side space 14S2 flows in the washing solution introduction pipe. The washing solution flows into the downstream-side space 14S2, i.e., is supplied to the downstream-side space 14S2, through the washing solution introduction pipe and the introduction connector 14B.

The introduction port 143 is at a position closer to the flow-path formation body 12 than the partition member 144 is to in the supply port opening direction (the upper-lower direction in FIGS. 1 and 2) as the direction in which the supply port 142 opens to the side surface 12C. The introduction port 143 opens in a direction (a right-left direction in FIGS. 1 and 2) perpendicular to the supply port opening direction (the upper-lower direction in FIGS. 1 and 2).

The discharge port 145 is communicated with the upstream-side space 14S1 such that discharging of the washing solution from the upstream-side space 14S1 through the discharge port 145 is allowed. Specifically, a discharge connector 14C is connected to the discharge port 145. A not-shown washing solution discharge pipe is connected to the discharge connector 14C, and the washing solution discharged from the upstream-side space 14S1 flows in the washing solution discharge pipe. That is, the washing solution is discharged from the upstream-side space 14S1 to the outside of the cooling water distribution header 14 through the washing solution discharge pipe and the discharge connector 14C.

The discharge port 145 is at a position closer to the supply port 142 than the partition member 144 is to in the direction (the upper-lower direction in FIGS. 1 and 2) in which the supply port 142 opens to the side surface 12C. The discharge port 145 opens in a discharge port opening direction (the right-left direction in FIGS. 1 and 2) perpendicular to the supply port opening direction (the upper-lower direction in FIGS. 1 and 2). The discharge port 145 is on the opposite side of the supply port 142 from the introduction port 143 in the direction (the right-left direction in FIGS. 1 and 2) perpendicular to the supply port opening direction (the upper-lower direction in FIGS. 1 and 2).

In the heat exchanger 10, the cooling water supplied into the upstream-side space 14S1 through the supply port 142 passes through the fluid passable portion 14M of the partition member 144, and thereafter, is distributed to each of the multiple cooling flow paths. When the cooling water is supplied to the cooling water distribution space 14S as described above, any of the introduction port 143 and the discharge port 145 is closed.

The fluid passable portion 14M allows the cooling water supplied into the cooling water distribution space 14S through the supply port 142 to flow into the downstream-side space 14S2 from the upstream-side space 14S1 while preventing the foreign substance contained in the cooling water from flowing from the upstream-side space 14S1 to the downstream-side space 14S2. Thus, no foreign substance is contained in the cooling water having passed through the fluid passable portion 14M. The foreign substance adheres to the fluid passable portion 14M, and remains in the upstream-side space 14S1.

That is, in the heat exchanger 10, the cooling water from which the foreign substance has been removed can be supplied to each of the multiple cooling flow paths. This can prevent clogging of any of the multiple cooling flow paths with the foreign substance, i.e., occurrence of clogging of the cooling flow paths.

However, the foreign substance removed from the cooling water as described above adheres to the fluid passable portion 14M, and gradually degrades a foreign substance removal function of the fluid passable portion 14M. For recovering the foreign substance removal function, maintenance as the process of removing the foreign substance adhering to the fluid passable portion 14M from the fluid passable portion 14M needs to be performed.

In the heat exchanger 10, such maintenance can be performed utilizing washing water supplied to the downstream-side space 14S2 through the introduction port 143. Specifically, the maintenance is performed as follows.

First, supply of the cooling water into the upstream-side space 14S1 through the supply port 142 is stopped, and thereafter, the supply port 142 is closed. Subsequently, the introduction port 143 and the discharge port 145 are opened, and a state in which the washing water can flow into the cooling water distribution space 14S is brought. In this state, the washing water is supplied to the downstream-side space 14S2 through the introduction port 143. After having flowed into the upstream-side space 14S1 through the fluid passable portion 14M, the washing water is discharged from the heat exchanger 10 through the discharge port 145.

A direction in which the washing solution supplied to the downstream-side space 14S2 through the introduction port 143 passes through the fluid passable portion 14M is a direction opposite to a direction in which the cooling water supplied to the upstream-side space 14S1 through the supply port 142 passes through the fluid passable portion 14M. This can remove the foreign substance adhering to the fluid passable portion 14M from the fluid passable portion 14M when the washing solution passes through the fluid passable portion 14M. Moreover, the washing solution removed from the fluid passable portion 14M as described above and containing the foreign substance can be discharged to the outside of the cooling water distribution header 14 through the discharge port 145 formed at the header body 140.

This eliminates the necessity of removing the partition member 144 as a maintenance target in the heat exchanger 10 from the cooling water distribution header 14 for the purpose of maintenance. As a result, maintenance of the partition member 144 can be facilitated.

Further, the introduction port 143 in the heat exchanger 10 opens in the direction (the right-left direction in FIGS. 1 and 2) perpendicular to the supply port opening direction (the upper-lower direction in FIGS. 1 and 2). This can prevent the washing solution supplied to the downstream-side space 14S2 through the introduction port 143 from directly colliding with the fluid passable portion 14M.

Variation of Embodiment

Figure 4:
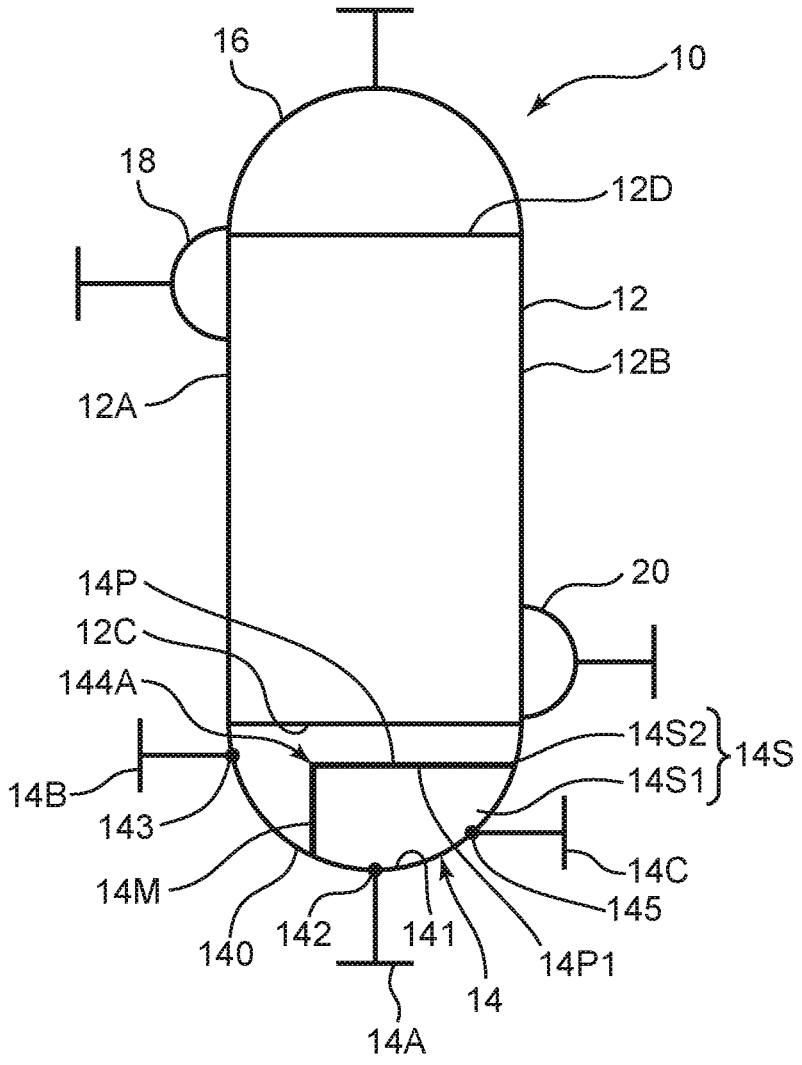
FIG. 4 is a side view of a heat exchanger according to a variation of the embodiment.

Subsequently, a variation of the embodiment of the present invention will be described with reference to FIG. 4. FIG. 4 is a side view showing an outline configuration of a heat exchanger 10A as a fluid flow-path device according to the variation.

Figure 5:
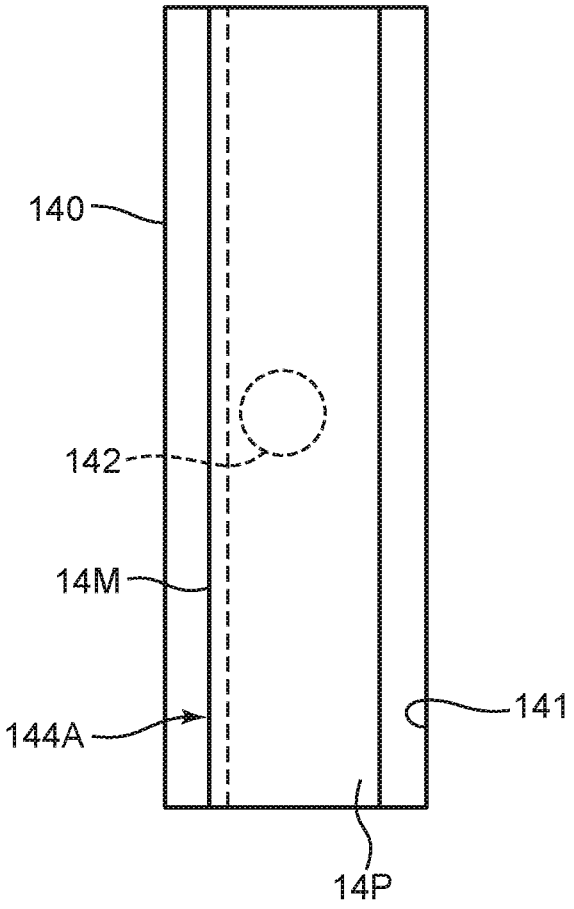
FIG. 5 is a plan view of a partition member from above FIG. 4, the partition member being positioned inside a header body of a cooling water distribution header of the heat exchanger shown in FIG. 4.
Figure 6:
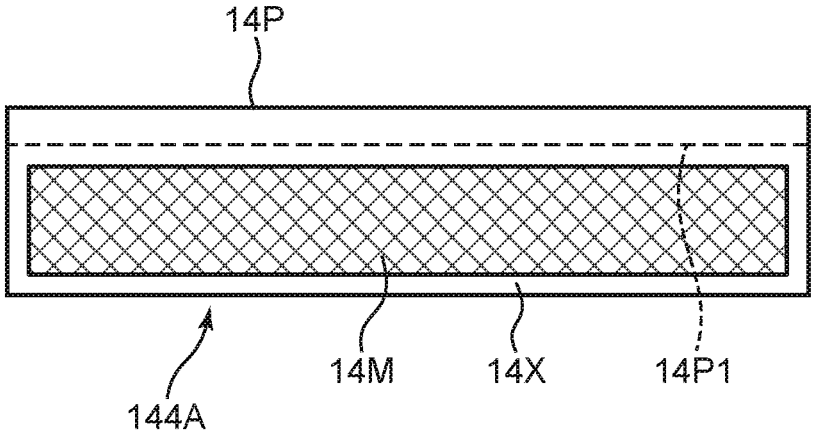
FIG. 6 is a back view showing a state in which only the partition member included in the heat exchanger shown in FIG. 4 is viewed from the left side of FIG. 4.

The heat exchanger 10A includes a partition member 144A instead of the partition member 144 in the heat exchanger 10. The partition member 144A will be described with reference to FIGS. 5 and 6. FIG. 5 is a plan view of the partition member 144A from above FIG. 4, the partition member 144A being positioned inside the header body 140. FIG. 6 is a back view of only the partition member 144A from the left side of FIG. 4.

In addition to the surrounding portion 14X and the fluid passable portion 14M of the partition member 144, the partition member 144A further includes a plate-shaped fluid passage blocking portion 14P formed integrally with the surrounding portion 14X. The fluid passage blocking portion 14P blocks not only the foreign substance contained in the cooling water, but also passage of the cooling water and the washing solution. The fluid passage blocking portion 14P includes a guide surface 14P1. The guide surface 14P1 expands in a guide direction (a right-left direction in FIG. 4) perpendicular to the supply port opening direction (an upper-lower direction in FIG. 4) as the direction in which the supply port 142 opens. That is, the guide surface 14P1 is parallel with the side surface 12C of the flow-path formation body 12. The fluid passage blocking portion 14P is positioned facing the supply port 142. In other words, the fluid passage blocking portion 14P is positioned to cover the entirety of the supply port 142 as viewed in the direction in which the supply port 142 opens.

The fluid passable portion 14M of the partition member 144A expands in the direction (the upper-lower direction in FIG. 4) perpendicular to the guide direction (the right-left direction in FIG. 4) in which the guide surface 14P1 of the fluid passage blocking portion 14P expands. Thus, the fluid passable portion 14M and the fluid passage blocking portion 14P according to this embodiment are perpendicular to each other. The fluid passable portion 14M is positioned outside the supply port 142 in the guide direction (the right-left direction in FIG. 4) in which the guide surface 14P1 of the fluid passage blocking portion 14P expands.

The introduction port 143 is positioned on the opposite side of the fluid passage blocking portion 14P from the supply port 142 in the supply port opening direction (the upper-lower direction in FIG. 4). In other words, as viewed along a direction in which the introduction port 143 opens, the introduction port 143 is provided at a position not overlapping with the fluid passable portion 14M. The introduction port 143 opens in the guide direction (the right-left direction in FIG. 4) perpendicular to the supply port opening direction (the upper-lower direction in FIG. 4). The introduction port 143 is positioned on the opposite side of the fluid passable portion 14M from the supply port 142 in the guide direction (the right-left direction in FIG. 4) perpendicular to the supply port opening direction (the upper-lower direction in FIG. 4).

In the heat exchanger 10A, the cooling water supplied to the upstream-side space 14S1 through the supply port 142 collides with the fluid passage blocking portion 14P before passing through the fluid passable portion 14M. The cooling water having collided with the fluid passage blocking portion 14P as described above flows, along the guide surface 14P1 of the fluid passage blocking portion 14P, in the guide direction (the right-left direction in FIG. 4) perpendicular to the supply port opening direction (the upper-lower direction in FIG. 4) in the upstream-side space 14S1. That is, the guide surface 14P1 guides the cooling water in the guide direction. Due to collision of the cooling water with the fluid passage blocking portion 14P, the flow velocity of such cooling water is lower than the flow velocity of the cooling water before collision with the fluid passage blocking portion 14P. This can improve durability of the fluid passable portion 14M as compared to a case where the cooling water supplied to the upstream-side space 14S1 through the supply port 142 directly collides with the fluid passable portion 14M.

The fluid passable portion 14M of the heat exchanger 10A expands in the direction (the upper-lower direction in FIG. 4) perpendicular to the guide direction (the right-left direction in FIG. 4) as a direction in which the cooling water having collided with the fluid passage blocking portion 14P flows along the fluid passage blocking portion 14P, and therefore, the cooling water flowing along the fluid passage blocking portion 14P after having collided with the fluid passage blocking portion 14P easily passes through the fluid passable portion 14M.

The introduction port 143 of the heat exchanger 10A is provided at the position not overlapping with the fluid passable portion 14M as viewed along the direction in which the introduction port 143 opens. This can prevent the washing solution supplied to the downstream-side space 14S2 through the introduction port 143 from directly colliding with the fluid passable portion 14M. This can enhance the durability of the fluid passable portion 14M.

The embodiments of the present invention have been described above in detail. However, these embodiments are merely examples, and the present invention is not interpreted in a limited manner by description of the embodiments above. The present invention also includes the following aspects, for example.

The fluid flow-path device according to the present invention is not limited to one applied to the heat exchanger according to the above-described embodiments. The present invention is also applicable to a reaction device, for example.

In the above-described embodiments, the cooling water for cooling the fluid (the target gas) as a processing target corresponds to the "target fluid" according to the present invention, and the foreign substance contained in the cooling water is a removal target. However, the "target fluid" according to the present invention may be the fluid as the processing target. That is, the present invention also includes such an aspect that the foreign substance contained in the fluid as the processing target is removed.

The present invention is not limited to such an aspect that the cooling water containing the foreign substance flows in the upper-lower direction in the flow-path formation body 12 as in the above-described embodiments. The present invention also includes such an aspect that the target fluid containing the foreign substance flows in the right-left direction in the flow-path formation body.

In the aspect including the fluid passage blocking portion among the aspects of the present invention, the fluid passage blocking portion 14P may be provided at a portion of the fluid passable portion 14M overlapping with the supply port 142 as viewed along the supply port opening direction in the above-described embodiment shown in FIGS. 1 to 3.

Moreover, the fluid passage blocking portion may be a plate-shaped member provided between the supply port 142 and the fluid passable portion 14M in the supply port opening direction in the above-described embodiment shown in FIGS. 1 to 3, and the cooling water supplied to the upstream-side space 14S1 through the supply port 142 may collide with such a plate-shaped member.

Provided is, as described above, a fluid flow-path device including a member configured to block passage of a foreign substance and configured so that the process of removing the foreign substance adhering to the member from the member can be facilitated. Provided is a fluid flow-path device for supplying target fluid. The fluid flow-path device includes a flow-path formation body having multiple flow paths and a side surface, the multiple flow paths being formed inside the flow-path formation body and allowing the flow of the target fluid in the flow paths and an inlet of each of the multiple flow paths opening at the side surface; and a distribution header arranged on the side surface to cover the inlet of each of the multiple flow paths and forming a distribution space for distributing the target fluid to each of the multiple flow paths between the distribution header and the flow-path formation body. The distribution header includes a header body having a recessed portion and a supply port, the recessed portion opening to the side surface to form the distribution space in a state in which the distribution header is arranged on the side surface and the supply port being communicated with the distribution space to allow supply of the target fluid to the distribution space through the supply port; and a partition member provided at the header body at a position in the distribution space, partitioning the distribution space into an upstream-side space communicated with the supply port and a downstream-side space communicated with each of the multiple flow paths at a position closer to the flow-path formation body than the upstream-side space is to, and having a fluid passable portion allowing the target fluid supplied into the distribution space through the supply port to flow to the downstream-side space from the upstream-side space while preventing a foreign substance contained in the target fluid from flowing to the downstream-side space from the upstream-side space. The header body is formed with an introduction port and a discharge port, the introduction port is communicated with the downstream-side space such that washing fluid for discharging the foreign substance adhering to the fluid passable portion from the inside of the space to the outside of the distribution header is supplied to the downstream-side space through the introduction port and passes through the fluid passable portion in a direction from the downstream-side space toward the upstream-side space to remove the foreign substance adhering to the fluid passable portion from the fluid passable portion, and the discharge port is communicated with the upstream-side space such that the washing fluid containing the foreign substance removed from the fluid passable portion by passing through the fluid passable portion in the direction from the downstream-side space toward the upstream-side space is discharged to the outside of the distribution header from the upstream-side space through the discharge port.

In the fluid flow-path device, the target fluid supplied into the distribution space of the distribution header through the supply port is distributed to each of the multiple flow paths after having passed through the fluid passable portion of the partition member configured to partition the space in the distribution header into the upstream-side space and the downstream-side space. This can supply, to each of the multiple flow paths, the target fluid from which the foreign substance has been removed. As a result, clogging of any of the multiple flow paths with the foreign substance, i.e., occurrence of clogging of the flow paths, can be prevented.

Further, the fluid flow-path device allows supply of the washing fluid to the downstream-side space through the introduction port, and the direction in which the washing fluid passes through the fluid passable portion of the partition member is a direction opposite to the direction in which the target fluid supplied to the upstream-side space through the supply port passes through the fluid passable portion of the partition member. This can remove, from the fluid passable portion, the foreign substance adhering to the fluid passable portion when the washing fluid supplied to the downstream-side space through the introduction port passes through the fluid passable portion of the partition member. In addition, the washing fluid containing the foreign substance removed from the fluid passable portion as described above can be discharged to the outside of the distribution header through the discharge port formed at the header body.

That is, in the fluid flow-path device, maintenance as the process of removing the foreign substance adhering to the fluid passable portion from the fluid passable portion is implemented in such a manner that the washing fluid is supplied to the distribution space in the distribution header through the introduction port. This eliminates the necessity of detaching the partition member as a target for maintenance from the distribution header for the purpose of maintenance. As a result, maintenance of the partition member is facilitated.

Generally, the distribution header has been already designed as a pressure-resistant member with a thickness necessary for a design pressure. Thus, even when a strainer structure including the fluid passable portion is employed in the distribution header, it is not necessary to use a member having a significantly-great thickness for the purpose of pressure resistance.

In the fluid flow-path device, the partition member preferably further includes a fluid passage blocking portion. The fluid passage blocking portion is a portion expanding in a direction perpendicular to a supply port opening direction as a direction in which the supply port opens to the side surface of the flow-path formation body and positioned facing the supply port to block passage of the target fluid, and is a portion with which the target fluid supplied to the upstream-side space through the supply port collides with the fluid passage blocking portion before passing through the fluid passable portion such that the flow velocity of the target fluid passing through the fluid passable portion in a direction from the upstream-side space toward the downstream-side space is decreased.

The fluid passage blocking portion can decrease the flow velocity of the target fluid before passage through the fluid passable portion by collision of the target fluid supplied to the upstream-side space through the supply port with the fluid passage blocking portion. This can improve durability of the fluid passable portion as compared to a case where the fluid supplied to the upstream-side space through the supply port directly collides with the fluid passable portion.

In the fluid flow-path device, the fluid passage blocking portion preferably has a guide surface. The guide surface preferably expands in a guide direction perpendicular to the supply port opening direction such that the target fluid supplied to the upstream-side space through the supply port and collided with the fluid passage blocking portion is guided in the guide direction in the upstream-side space. The fluid passable portion preferably expands in a direction perpendicular to the guide direction such that passage of the target fluid flowing in the guide direction along the guide surface of the fluid passage blocking portion after having collided with the fluid passage blocking portion is allowed.

The fluid passable portion in the above-described aspect expands in the direction perpendicular to the direction (the guide direction perpendicular to the supply port opening direction) in which the fluid collided with the fluid passage blocking portion flows along the fluid passage blocking portion, and therefore, the fluid collided with the fluid passage blocking portion and flowing along the guide surface easily passes through the fluid passable portion.

In the fluid flow-path device, for avoiding collision of the washing fluid supplied to the downstream-side space through the introduction port with the fluid passable portion, the introduction port is preferably positioned on the opposite side of the fluid passage blocking portion from the supply port in the supply port opening direction and on the opposite side of the fluid passable portion from the supply port in the guide direction, and preferably opens in the guide direction.

The introduction port is at a position not overlapping with the fluid passable portion as viewed along a direction in which the introduction port opens. This can prevent the washing fluid supplied to the downstream-side space through the introduction port from directly colliding with the fluid passable portion, and therefore, can enhance the durability of the fluid passable portion.

The invention claimed is:

1. A fluid flow-path device for supplying target fluid, comprising:

a flow-path formation body having multiple flow paths and a side surface, the multiple flow paths being formed inside the flow-path formation body and allowing a flow of the target fluid in the flow paths and an inlet of each of the multiple flow paths opening at the side surface; and a distribution header arranged adjacent to the side surface to cover the inlet of each of the multiple flow paths and forming a distribution space for distributing the target fluid to each of the multiple flow paths between the distribution header and the flow-path formation body, wherein the distribution header includes a header body having a distribution space and a supply port, the distribution space opening to the side surface in a state in which the distribution header is arranged adjacent to the side surface and the supply port being communicated with the distribution space to allow supply of the target fluid to the distribution space through the supply port, and a partition member provided at the header body at a position in the distribution space, partitioning the distribution space into an upstream-side space communicated with the supply port and a downstream-side space communicated with each of the multiple flow paths at a position closer to the flow-path formation body than the upstream-side space, and having a fluid passable portion allowing the target fluid supplied into the space through the supply port to flow to the downstream-side space from the upstream-side space while preventing a foreign substance contained in the target fluid from flowing to the downstream-side space from the upstream-side space, and the header body is formed with an introduction port and a discharge port, the introduction port is communicated with the downstream-side space such that washing fluid for discharging the foreign substance adhering to the fluid passable portion from an inside of the cooling water distribution space to an outside of the distribution header is supplied to the downstream-side space through the introduction port and passes through the fluid passable portion in a direction from the downstream-side space toward the upstream-side space to remove the foreign substance adhering to the fluid passable portion from the fluid passable portion, and the discharge port is communicated with the upstream-side space such that the washing fluid containing the foreign substance removed from the fluid passable portion and which passes through the fluid passable portion in the direction from the downstream-side space toward the upstream-side space is discharged to the outside of the distribution header from the upstream-side space through the discharge port.

2. The fluid flow-path device according to claim 1, wherein the partition member further includes a fluid passage blocking portion, and the fluid passage blocking portion is a portion expanding in a direction perpendicular to a supply port opening direction, wherein the supply port opening direction is a direction which extends from the supply port to the side surface of the flow-path formation body and positioned facing the supply port to block passage of the target fluid, and is a portion with which the target fluid supplied to the upstream-side space through the supply port collides with the fluid passage blocking portion before passing through the fluid passable portion such that a flow velocity of the target fluid passing through the fluid passable portion in a direction from the upstream-side space toward the downstream-side space is decreased.

3. The fluid flow-path device according to claim 2, wherein the fluid passage blocking portion has a guide surface, the guide surface expands in a guide direction perpendicular to the supply port opening direction such that the target fluid supplied to the upstream-side space through the supply port and collided with the fluid passage blocking portion is guided in the guide direction in the upstream-side space, and the fluid passable portion expands in a direction perpendicular to the guide direction such that passage of the target fluid flowing in the guide direction along the guide surface of the fluid passage blocking portion after having collided with the fluid passage blocking portion is allowed.

4. The fluid flow-path device according to claim 3, wherein for avoiding collision of the washing fluid supplied to the downstream-side space through the introduction port with the fluid passable portion, the introduction port is positioned on an opposite side of the fluid passage blocking portion from the supply port in the supply port opening direction and on an opposite side of the fluid passable portion from the supply port in the direction perpendicular to the guide direction, and opens in the guide direction.

* * * * *